US010954043B2

(12) United States Patent
Taruno

(10) Patent No.: US 10,954,043 B2
(45) Date of Patent: Mar. 23, 2021

(54) CAP AND DELAMINATABLE CONTAINER

(71) Applicant: KYORAKU CO., LTD., Kyoto (JP)

(72) Inventor: Shinsuke Taruno, Kanagawa (JP)

(73) Assignee: KYORAKU CO., LTD., Kyoto (JP)

( * ) Notice: Subject to any disclaimer, the term of this patent is extended or adjusted under 35 U.S.C. 154(b) by 0 days.

(21) Appl. No.: 16/480,064

(22) PCT Filed: Jan. 26, 2018

(86) PCT No.: PCT/JP2018/002523
§ 371 (c)(1),
(2) Date: Jul. 23, 2019

(87) PCT Pub. No.: WO2018/139591
PCT Pub. Date: Aug. 2, 2018

(65) Prior Publication Data

US 2019/0375561 A1 Dec. 12, 2019

(30) Foreign Application Priority Data

Jan. 30, 2017 (JP) ..... JP2017-014537

(51) Int. Cl.
*B65D 47/20* (2006.01)
*B65D 1/02* (2006.01)
*B65D 41/02* (2006.01)

(52) U.S. Cl.
CPC ..... *B65D 47/2018* (2013.01); *B65D 1/023* (2013.01); *B65D 41/02* (2013.01); *B65D 2203/02* (2013.01); *B65D 2547/063* (2013.01)

(58) Field of Classification Search
CPC .... B65D 47/2018; B65D 1/023; B65D 41/02; B65D 2203/02; B65D 2547/063
(Continued)

(56) References Cited

U.S. PATENT DOCUMENTS 2,128,035 A * 8/1938 Boetel ..... B65D 47/2081 222/92
4,635,826 A * 1/1987 Hatakeyama ..... B65D 47/2075 215/21
(Continued)

FOREIGN PATENT DOCUMENTS

JP 2004-067099 A 3/2004
JP 2012-192975 A 10/2012
(Continued)

OTHER PUBLICATIONS

Translation of International Search Report dated Apr. 10, 2018 in corresponding International Application No. PCT/JP2018/002523; 5 pages.
(Continued)

*Primary Examiner* — Benjamin R Shaw
(74) *Attorney, Agent, or Firm* — Maier & Maier, PLLC

(57) ABSTRACT

A cap with improved usability is provided. The present invention provides a cap including a cap body to be fitted to a mouth of a container, wherein the cap is configured to include: a valve seat having a flow aperture; a valve body to be separated from or seated on the valve seat so as to open and close the flow aperture; and a biasing member to bias the valve body in a seating direction, and configured to increase a flow area in which contents flow with an increase in a displacement of the valve body, and the cap further includes a displacement restricting section to restrict the displacement of the valve body.

10 Claims, 4 Drawing Sheets

(58) Field of Classification Search
USPC ..... 222/105
See application file for complete search history.

(56) References Cited

U.S. PATENT DOCUMENTS

| | | | | |
|---|---|---|---|---|
| 4,785,978 | A * | 11/1988 | Kano | B05B 11/047 215/309 |
| 5,275,312 | A | 1/1994 | Labruzzo | |
| 5,813,576 | A * | 9/1998 | Iizuka | B05B 11/3087 222/190 |
| 2003/0085240 | A1* | 5/2003 | Dark | B65D 47/2081 222/494 |
| 2003/0230596 | A1 | 12/2003 | Masuda | |
| 2004/0007601 | A1* | 1/2004 | Masuda | B65D 47/2075 222/494 |
| 2004/0050872 | A1* | 3/2004 | Masuda | B65D 35/14 222/212 |
| 2004/0112920 | A1* | 6/2004 | Felten | B65D 47/2081 222/212 |
| 2004/0134940 | A1* | 7/2004 | Hearld | B65D 47/2018 222/481.5 |
| 2004/0144809 | A1* | 7/2004 | Kerman | B65D 47/2075 222/494 |
| 2005/0129455 | A1* | 6/2005 | Avalle | A45D 40/26 401/266 |
| 2012/0211530 | A1 | 8/2012 | Bloom | |
| 2012/0305607 | A1* | 12/2012 | Geiger | B65D 47/2025 222/494 |
| 2014/0144938 | A1* | 5/2014 | Kakuta | B65D 47/2093 222/105 |
| 2014/0209644 | A1* | 7/2014 | Socier | B65D 47/2031 222/494 |
| 2015/0353245 | A1* | 12/2015 | Sakimura | B65D 47/20 222/545 |
| 2017/0107024 | A1* | 4/2017 | Tamarindo | B65D 75/5883 |
| 2018/0370673 | A1* | 12/2018 | Taruno | B65D 77/225 |
| 2019/0291930 | A1* | 9/2019 | Sakimura | B65D 1/02 |

FOREIGN PATENT DOCUMENTS

| | | | |
|---|---|---|---|
| JP | 2013-241197 | A | 12/2013 |
| JP | 2016-084180 | A | 5/2016 |
| JP | 5963323 | B2 | 8/2016 |
| WO | 92/21569 | A1 | 12/1992 |
| WO | 2015/173979 | A1 | 11/2015 |

OTHER PUBLICATIONS

Extended European Search Report dated Jan. 28, 2020, in corresponding European patent application No. 18744266.0; 7 pages.

* cited by examiner

CAP AND DELAMINATABLE CONTAINER

TECHNICAL FIELD

The present invention relates to a cap including a check valve and a delaminatable container including the cap.

BACKGROUND ART

Conventionally, delaminatable containers are known that include a container body having an outer shell and an inner bag, the inner bag to be shrunk with a decrease in contents. Such a delaminatable container is usually provided with a cap having a check valve as described in PTL 1 and is configured to open the check valve and discharge the contents by squeezing the container body and close the check valve by stopping squeezing.

CITATION LIST

Patent Literature

PTL 1: JP 2013-241197A

SUMMARY OF INVENTION

Technical Problem

However, the cap in PTL 1 has a risk of degradation of usability due to discharge of more than an expected amount of the contents or occurrence of more than estimated pulsation of the contents depending on the degree of squeezing.

The present invention has been made in view of such circumstances and is to provide a cap with improved usability.

Solution to Problem

The present invention provides a cap comprising a cap body to be fitted to a mouth of a container, wherein the cap is configured to include: a valve seat having a flow aperture; a valve body to be separated from or seated on the valve seat so as to open and close the flow aperture; and a biasing member to bias the valve body in a seating direction, and configured to increase a flow area in which contents flow with an increase in a displacement of the valve body, and the cap further includes a displacement restricting section to restrict the displacement of the valve body.

The present inventor made an intensive review to find that such a cap as in PTL 1 has a structure to increase the flow area in which the contents flow with an increase in the displacement of the valve body of the check valve, and when the container body is squeezed too strong, the valve body is opened widely to discharge more than an expected amount of the contents or to create more than estimated pulsation of the contents as a result of closing the valve body in reaction to wide opening, causing degradation of usability and thus has come to complete the present invention of restricting the displacement of the valve body.

Various embodiments of the present invention are described below as examples. The embodiments described below may be combined with each other.

Preferably, the displacement restricting section restricts the displacement of the valve body to be 0.8 times or less a diameter of the flow aperture.

Preferably, the displacement restricting section restricts the displacement of the valve body to 1.5 mm or less.

Preferably, the displacement restricting section restricts the displacement of the valve body from 0.4 to 0.8 mm.

Preferably, the biasing member is formed of a plurality of elastic pieces radially extending from an outer circumferential portion of the valve body.

Preferably, the cap body includes: an inner tube section having the valve seat; and a discharge portion mounted to the inner tube section and having an outlet, the inner tube section and the discharge portion forming an intermediate space, and the cap is configured to displace the valve body in the intermediate space.

Preferably, the displacement restricting section is formed of a plurality of projections formed on a surface on a side of the intermediate space of the discharge portion.

Preferably, the displacement restricting section is formed of a spacer disposed between the discharge portion and the check valve.

The present invention also provides a delaminatable container including a container body having an outer shell and an inner bag, the inner bag to be shrunk with a decrease in the contents, wherein the cap of any of the above configurations is fitted to a mouth of the container body.

DESCRIPTION OF EMBODIMENTS

Embodiments of the present invention are described below. Various characteristics in the embodiments described below may be combined with each other. Each characteristic is independently inventive.

Figure 1:
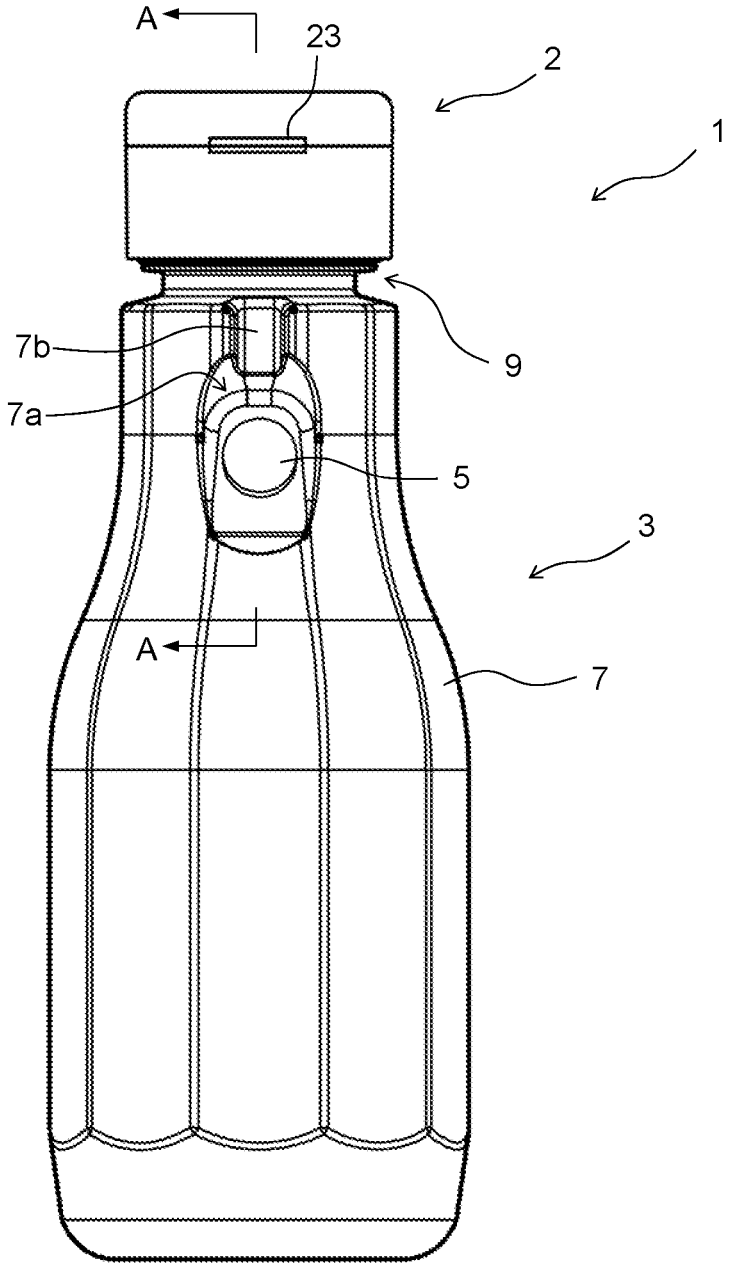
FIG. 1 is a front view of a delaminatable container 1 according to a first embodiment of the present invention.
Figure 2A:
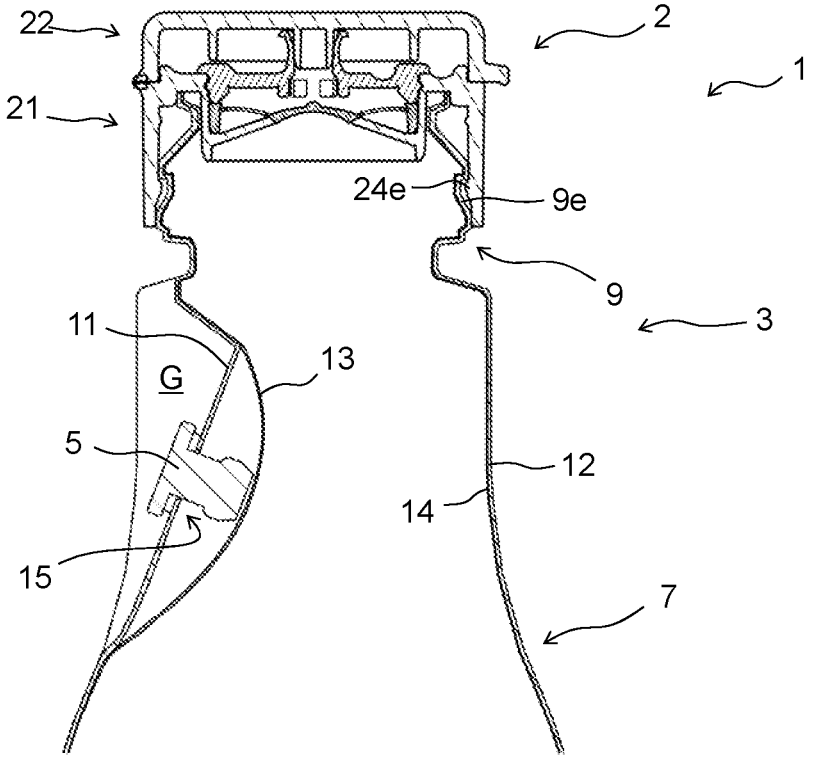
FIG. 2A is a cross-sectional view taken along A-A in FIG. 1.

As illustrated in FIGS. 1 and 2A, a delaminatable container 1 in an embodiment of the present invention includes a cap 2 and a container body 3. The container body 3 is provided with a valve member 5, a storage portion 7 to store the contents, and a mouth 9 to discharge the contents from the storage portion 7. In the present embodiment, the cap 2 is press fitted, and as illustrated in FIG. 2A, the cap 2 is mounted by engaging an engagement section 9*e* formed in the mouth 9 of the container body 3 with an engaged section 24*e* formed in the cap 2. Noted that the cap 2 may be mounted by threading.

As illustrated in FIG. 2A, the container body 3 includes an outer layer 11 and an inner layer 13 in the storage portion 7 and the mouth 9, where the outer layer 11 constitutes an outer shell 12 and the inner layer 13 constitutes an inner bag 14. Due to delamination of the inner layer 13 from the outer layer 11 with a decrease in the contents, the inner bag 14 separates from the outer shell 12 to be shrunk. Preliminary delamination is sometimes performed to delaminate the inner layer 13 from the outer layer 11 before storage of the contents in the storage portion 7. In this case, the inner layer 13 is contacted with the outer layer 11 by blowing air or storing the contents in the storage portion 7 after preliminary delamination. The inner layer 13 then separates from the outer layer 11 with a decrease in the contents. Meanwhile, when preliminary delamination is not performed, the inner layer 13 is delaminated from the outer layer 11 in discharge of the contents to separate from the outer layer 11.

Figure 2B:
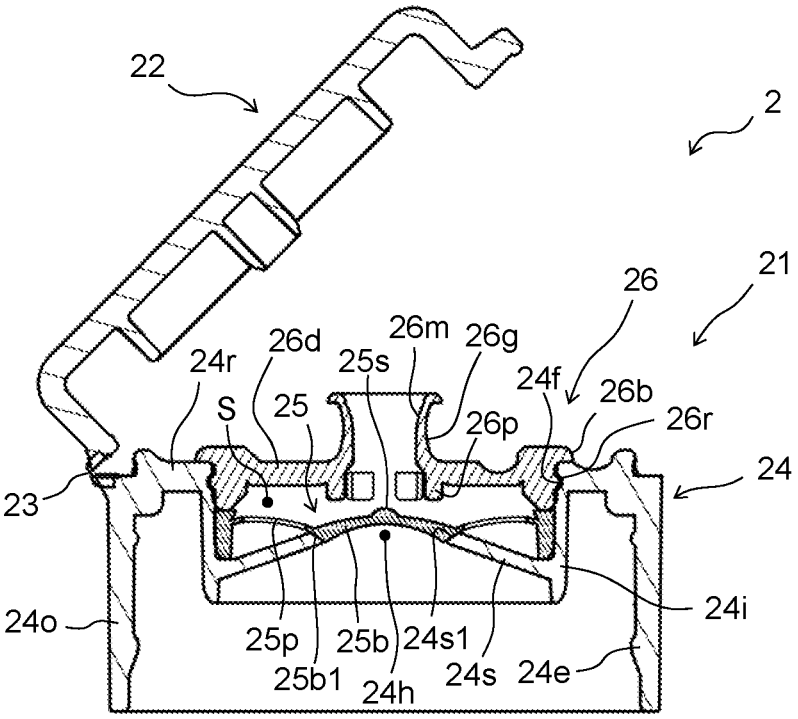
FIG. 2B is an enlarged cross-sectional view of a cap 2 of the delaminatable container 1 in FIG. 2A and illustrates a state where a cap cover 22 is opened.

The valve member 5 is, as illustrated in FIGS. 2A and 2B, inserted into a fresh air inlet 15 formed in the storage portion 7 to regulate entrance and exit of air between the outside and a space G between the outer shell 12 and the inner bag 14. The configuration examples of the valve member 5 include a configuration where a gap between the valve member 5 and an edge of the fresh air inlet 15 is opened and closed by movement of the valve member 5 for opening and closing of the fresh air inlet 15 by the valve member 5 and a configuration where the valve member 5 itself is provided with a through hole and an on-off valve, which acts to open and close the through hole for opening and closing of the fresh air inlet 15. In addition, configurations without providing the valve member 5 are allowed to regulate entrance and exit of air by placing a filter on the fresh air inlet 15 or by simply closing the fresh air inlet 15 with a finger or the like for discharging the contents. The fresh air inlet 15 may be provided in the mouth 9 to use a cap having a check valve in communication with the fresh air inlet 15.

The valve member 5 in any of the above configurations is configured to allow compression of the inner bag 14 by closing the fresh air inlet 15 when the outer shell 12 is compressed to introduce fresh air into the space G when the compressive force to the outer shell 12 is released.

The storage portion 7 is covered with a shrink film after the valve member 5 is mounted. At this point, to avoid interference of the valve member 5 with the shrink film, the valve member 5 is mounted to a valve member mounting recess 7*a* provided in the. In addition, not to tightly close the valve member mounting recess 7*a* with the shrink film, an air circulation groove 7*b* is provided that extends in the direction from the valve member mounting recess 7*a* to the mouth 9 (refer to FIG. 1).

Regarding the layer structure of the container body 3, the outer layer 11 is formed thicker than the inner layer 13 so as to increase the restorability thereof. The outer layer 11 is formed of, for example, low-density polyethylene, linear low-density polyethylene, high-density polyethylene, polypropylene, an ethylene-propylene copolymer, or a mixture thereof, or the like. The outer layer 11 may have a multilayer structure. The inner layer 13 preferably has a multilayer structure. Examples of the layer in contact with the outer layer 11 include an EVOH layer 13*a* of an ethylene-vinyl alcohol copolymer (EVOH) resin, and examples of the layer in contact with the contents include an inner surface layer 13*b* of polyolefin, such as low-density polyethylene, linear low-density polyethylene, high-density polyethylene, polypropylene, an ethylene-propylene copolymer, and a mixture thereof. The adhesion layer 13*c* is preferably used between the EVOH layer and the inner surface layer.

Then, referring to FIG. 2B and FIGS. 3A to 3C, the cap 2 is described. The cap 2 in the present embodiment includes, as illustrated in FIG. 2B, a cap body 21 and a cap cover 22, which are formed of a synthetic resin. The cap body 21 and the cap cover 22 are connected by a hinge 23 to allow opening and closing of the cap cover 22. The cap body 21 is composed of three members of a main cap member 24, a check valve 25, and a discharge member 26 as the discharge portion. The synthetic resin to form the check valve 25 is more elastic than the synthetic resin forming the other members. For example, the check valve 25 is formed of a polyethylene elastomer and the other members are formed of polypropylene.

The main cap member 24 is configured with a cylindrical outer tube section 24*o*, a cylindrical inner tube section 24*i* concentrically disposed inside the outer tube section 24*o*, and an annular portion 24*r* connecting upper ends of the outer tube section 24*o* and the inner tube section 24*i* with each other. The outer tube section 24*o* has a lower inner circumferential surface having the engaged section 24*e* formed to be engaged with the engagement section 9*e* of the mouth 9. The inner tube section 24*i* has a lower inner circumferential surface, where an annular valve seat 24*s* is formed that extends diagonally above toward the radial center and has a flow aperture 24*h* at the center. The valve seat 24*s* has an inner circumferential surface 24*s*1 in a tapered shape inclined above. The inner tube section 24*i* has an upper inner circumferential surface, where a fitting recess 24*f* is formed over the entire circumference.

Figure 3A:
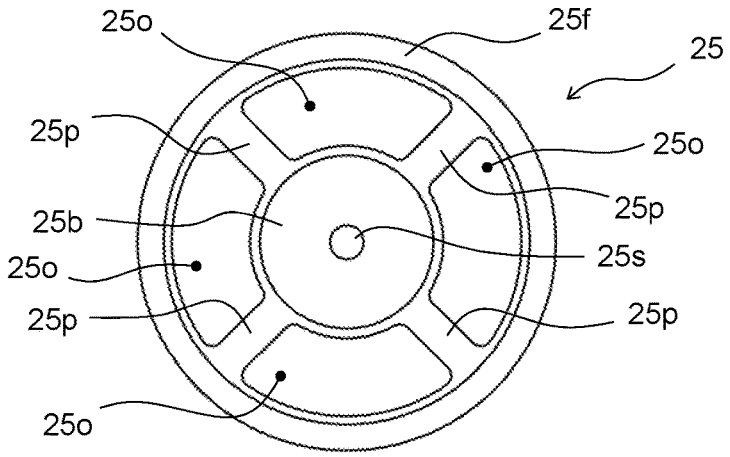
FIG. 3A is a front view of a check valve 25 of the cap 2.

The check valve 25 is, as illustrated in FIGS. 2B and 3A, formed of a valve body 25*b*, four elastic pieces 25*p*, and a circular outer frame 25*f*. The valve body 25*b* is a member in a domical shape having an upwardly curved cross-sectional shape (refer to FIG. 2B) and having a circular plan view (refer to FIG. 3A) and has a spherical convexity 25*s* formed at the center of its upper surface. The valve body 25*b* has an outer circumferential portion 25*b*1 in a tapered shape inclined below to be seated on the inner circumferential surface 24*s*1 of the valve seat 24*s* and is configured to open and close the flow aperture 24*h* by the valve body 25*b* being separated from or seated on the valve seat 24*s*. The flow aperture 24*h* and the corresponding valve body 25*b* do not have to be in a circular shape and may be in in a polygonal shape or an annular shape. Each elastic piece 25*p* extends, as illustrated in FIG. 2B, diagonally above in a somewhat curved manner radially from the outer circumferential portion of the valve body 25*b* and is connected to an upper end of an inner circumferential surface of the outer frame 25*f*. The four elastic pieces 25*p* are provided every 90° over the entire circumference, and four openings 25*o* to flow the contents are formed of two of the adjacent elastic pieces 25*p*, the outer frame 25*f*, and the valve body 25*b*. The four elastic pieces 25*p* bias the valve body 25*b* in the seating direction as the biasing member. The number of elastic pieces 25*p* is not limited to four and may be two, three, five or more. Noted that, to transfer the biasing force to the valve body 25*b*, the elastic pieces 25*p* preferably extend radially. The outer frame 25*f* is disposed to abut on an inner wall surface of the inner tube section 24*i* in an upper area of the valve seat 24*s* of the main cap member 24. In the present embodiment, the valve body 25*b*, the elastic pieces 25*p*, and the outer frame 25*f* of the check valve 25 are formed integrally as a single piece.

Figure 3B:
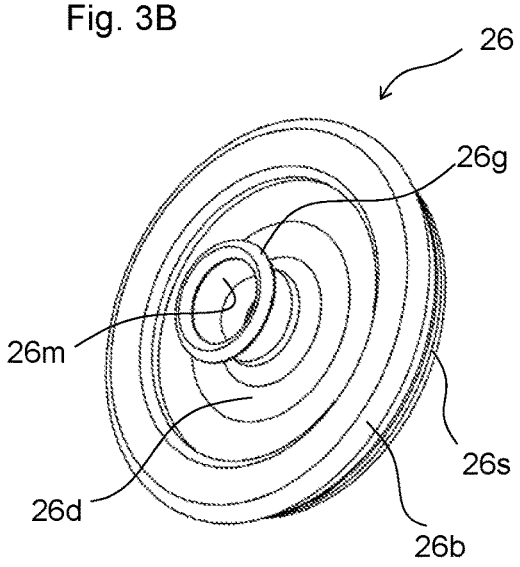
FIG. 3B is a perspective view of a discharge member 26 of the cap 2 taken from above.
Figure 3C:
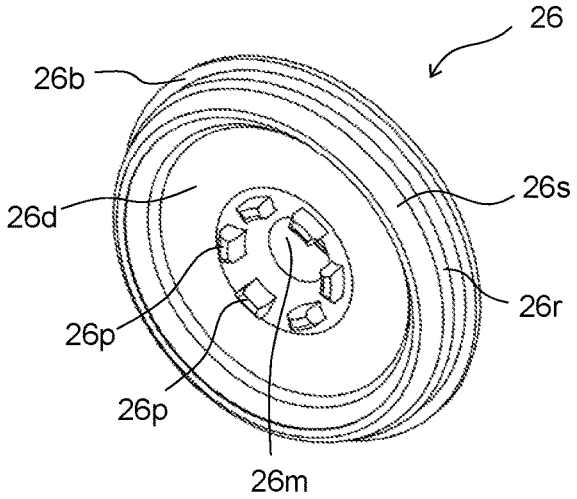
FIG. 3C is a perspective view of the discharge member 26 taken from below.

The discharge member 26 is provided with, as illustrated in FIGS. 2B, 3A, and 3B, a tubular support section 26*s* fitted to the inner tube section 24*i* of the main cap member 24, a tubular guide section 26*g* disposed concentrically with the tubular support section 26*s* and having an outlet 26*m*, and a sheet disk section 26*d* integrally connecting the tubular guide section 26*g* and an upper edge of the tubular support section 26*s* as a single piece. On the upper edge of the tubular support section 26*s*, a flange 26*b* outwardly extending in a radial direction is formed and configured to engage with an inner edge of the annular portion 24*r* of the main cap member 24. The tubular support section 26*s* has an outer circumferential surface with an annular rib 26*r* formed over the entire circumference to be fitted to the fitting recess 24*f* of the main cap member 24. When the main cap member 24 is fitted to the discharge member 26, a lower surface of the tubular support section 26*s* abuts on an upper surface of the outer frame 25*f* of the check valve 25 to fix the check valve 25. In this state, the valve seat 24*s* and the inner tube section 24*i* of the main cap member 24 and the discharge member 26 form an intermediate space S (refer to FIG. 2B) to allow displacement of the valve body 25*b* in the intermediate space S.

In addition, the discharge member 26 in the present embodiment is provided with, as illustrated in FIGS. 2B and 3B, a plurality of projections 26*p* protruding toward the valve body 25*b* in a position facing the valve body 25*b* on a surface on the intermediate space S side. In the present embodiment, six projections 26*p* are provided at regular intervals over the entire circumference (refer to FIG. 3B). The projections 26*p* function as the displacement restricting section to restrict the maximum displacement in the intermediate space S of the valve body 25*b* of the check valve 25, and for example, preferably restricts the maximum displacement with reference (zero displacement) to the valve body 25*b* seated on the valve seat 24*s* to be 0.8 times or less a diameter of the flow aperture 24*h* (that is, inner diameter of valve seat 24*s*) and even more preferably to be 0.4 times or less. The displacement is preferably restricted to be from 0.01 times to 0.2 times the diameter of the flow aperture 24*h*, preferably from 0.05 times to 0.1 times, more preferably from 0.06 times to 0.09 times, and even more preferably from 0.07 times to 0.08 times. Specifically, this value is, for example, 0.05, 0.055, 0.06, 0.065, 0.07, 0.075, 0.08, 0.085, 0.09, 0.095, 0.1, 0.2, 0.4, and 0.8 times or it may be in a range between any two values exemplified here. Such an actual displacement is preferably 1.5 mm or less, preferably from 0.4 to 0.8 mm, more preferably from 0.5 to 0.7 mm, and even more preferably from 0.65 to 0.75 mm. Specifically, this value is, for example, 0.4, 0.45, 0.5, 0.55, 0.6, 0.65, 0.7, 0.75, and 0.8 mm or it may be in a range between any two values exemplified here. Naturally, the maximum displacement may be reduced by increasing the degree of protrusion of the projections 26*p* and the maximum displacement may be increased by reducing the degree of protrusion of the projections 26*p*. The number of projections 26*p* is not limited to six as long as operations of the valve body 25*b* is restricted, and may be five or less or seven or more. Noted that sufficient gaps are preferably provided between the projections 26*p* to allow discharge of the contents even when the valve body 25*b* gets close to or abuts on the projections 26*p*.

Then, operations of the cap 2 according to the present embodiment are described.

For discharging the contents, the cap cover 22 is opened to expose the discharge member 26, the container body 3 is tilted to direct the tubular guide section 26*g* below, and the storage portion 7 of the container body 3 is squeezed. The valve body 25*b* is lifted from the valve seat 24*s* due to pressure rise in the storage portion 7 (inner bag 14), causing opening of the check valve 25 to discharge the contents in the storage portion 7 through the flow aperture 24*h* and the intermediate space S from the outlet 26*m*.

Then, after a required amount of the contents is discharged, the container body 3 is returned to an upright position and the squeezing of the storage portion 7 is stopped, thereby reducing the internal pressure of the storage portion 7 and closing the check valve 25 due to the biasing force of the elastic pieces 25*p*. Accordingly, an incoming flow of fresh air from the flow aperture 24*h* into the storage portion 7 (inner bag 14) is prevented, and fresh air thus does not enter the inner bag 14 to inhibit content degradation.

When a sudden force happens to be applied without realizing how strong it should be for discharging the contents by squeezing the storage portion 7 of the container body 3, the valve body 25*b* sometimes moves a lot to discharge more than an expected amount of the contents. There is another problem that squeezing with a weaker force after applying a sudden force causes sudden closing of the valve body 25*b* in reaction to wide opening the valve body 25*b* due to the biasing force of the elastic pieces 25*p* and repeating this cycle creates pulsation that results in degradation of usability. However, the cap 2 in the present embodiment has the discharge member 26 provided with the projections 26*p* to restrict the maximum displacement of the valve body 25*b* to the predetermined amount described above, thereby preventing opening of the valve body 25*b* more than necessary to allow improving the usability. In the present embodiment, the projections 26*p* are integrally formed with the discharge member 26 as a single piece and thus the displacement restricting section is readily configured only by changing the die shape of the discharge member without incorporating another member.

The present invention is allowed to be carried out in the following embodiments.

Figure 4A:
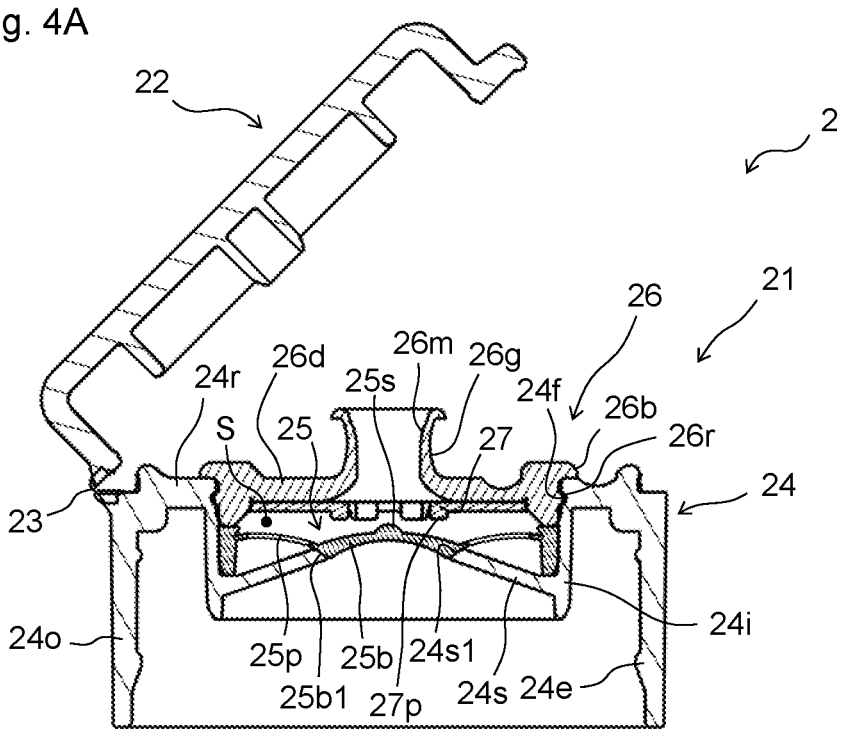
FIG. 4A is an enlarged cross-sectional view of a cap 2 according to a modification of the present invention.
Figure 4B:
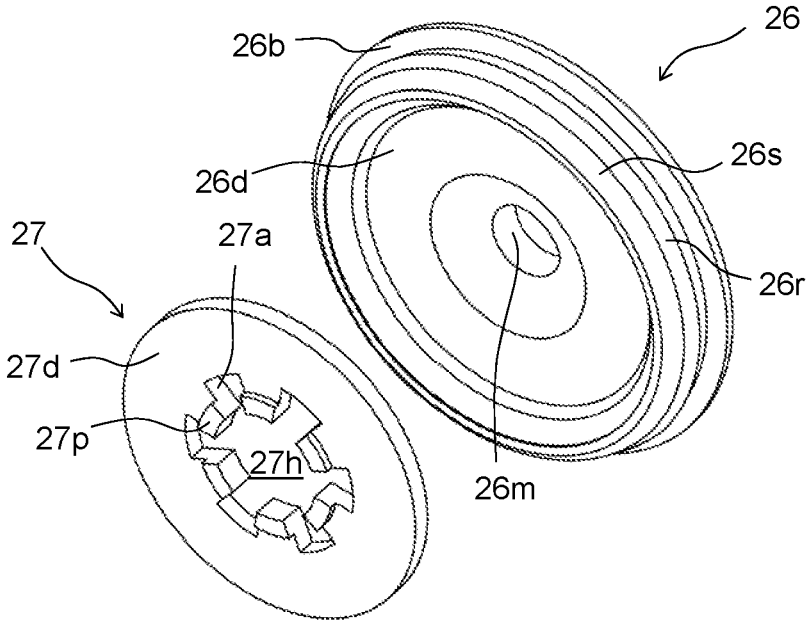
FIG. 4B is a perspective view illustrating a discharge member 26 and a spacer 27 of the cap 2 in FIG. 4A.

Although the projections 26*p* formed in the discharge member 26 are used as the displacement restricting section to restrict the displacement of the valve body 25*b* in the above embodiment, the displacement restricting section is not limited to such a configuration. For example, as illustrated in FIGS. 4A and 4B, a spacer 27 having a through hole 27*h*, as a separate member from the discharge member 26, is placed on the surface on the intermediate space S side of the discharge member 26 to configure the displacement restricting section with projections 27*p* formed with the spacer 27. Specifically, the spacer 27 has a thin annular portion 27*d* with an outer diameter approximately identical to the inner diameter of the tubular support section 26*s* of the discharge member 26, a plurality of arms 27*a* extending from the inner circumferential surface of the annular portion 27*d* toward the radial center, and projections 27*p* axially protruding from the ends of the respective arms 27*a*. The arms 27*a* and the projections 27*p* are formed at regular intervals over the entire circumference. Use of the spacer 27 in such a configuration as the displacement restricting section allows restriction of the displacement of the valve body 25*b* to improve the usability during discharge of the contents. In addition, by preparing a plurality of spacers 27 that are different in the length of the projections 27*p* and changing the spacer 27 to be mounted to the discharge member 26 in accordance with the application of the container and the type of contents, the cap 2 with appropriate usability in accordance with intended use is readily manufactured without changing the shapes of the other members.

In addition, as the displacement restricting section to restrict the displacement of the valve body 25*b*, projection(s) formed on a surface on the discharge member 26 side of the valve body 25*b* may be used. In this case, the projection on the valve body 25*b* side abuts on the surface on the intermediate space S side of the discharge member 26 to restrict the displacement of the valve body 25*b* itself.

The cap 2 of the present invention may be used for containers other than the delaminatable container 1, for example, a monolayer container in which the entire container is shrunk with discharge of the contents.

EXAMPLES

The present invention is described below further in detail using Test Examples. The present invention is, however, not at all limited to Test Examples below. In the following tests, the cap 2 had the outlet 26*m* with a diameter of 4.0 mm, the flow aperture 24*h* (valve body 25*b*) with a diameter of 8.0 mm. The contents were a liquid (soy sauce), and the container body 3 had a volume of 360 ml. In the tests, 11 test subjects performed discharge of the contents (liquid) in the container body 3 twice per subject and evaluated Samples having displacement restricting section (projections 26*p*) that caused the valve bodies 25*b* to have the four maximum displacements below and Comparative Example having no displacement restricting section from three perspectives of "whether the contents were discharged in an intended position", "whether the contents were discharged in a satisfactory manner", and "whether the contents were discharged in an appropriate amount". The evaluation was made in five grades (from 1 as poor to 5 as good).

Sample 1 0.4 mm (0.05 times of the flow aperture diameter)
Sample 2 0.5 mm (0.0625 times of the same)
Sample 3 0.6 mm (0.075 times of the same)
Sample 4 0.7 mm (0.0875 times of the same)
Comparative Example 2.0 mm or more

TABLE 1

| | Maximum Displacement of Valve Body 25b | Discharged in Intended Position? | Discharged in Satisfactory Manner? | Discharged in Appropriate Amount? |
|---|---|---|---|---|
| Sample 1 | 0.4 mm | 2.0 | 1.5 | 1.7 |
| Sample 2 | 0.5 mm | 3.6 | 3.4 | 3.5 |
| Sample 3 | 0.6 mm | 3.8 | 4.0 | 4.0 |
| Sample 4 | 0.7 mm | 3.8 | 3.7 | 3.7 |
| Comparative Example | 2 mm or more | 2.2 | 2.0 | 2.7 |

Poor 1 < 2 < 3 < 4 < 5 Good

Table 1 shows results of the above tests. Each value in Table 1 was obtained by rounding off an average of the evaluations by the 11 subjects to the first decimal place. As shown in Table 1, from any of the three perspectives, the scores get better with each increase in displacement within the maximum displacement ranging from 0.4 mm to 0.6 mm and the scores for 0.7 mm are somewhat worse than those for 0.6 mm. In comparison with Comparative Example, only for the maximum displacement of 0.4 mm, the results were worse than Comparative Example and the users felt discomfort. This is considered because the amount of discharge was not as much as expected relative to the degree of squeezing. The above findings indicate that the maximum displacement of the valve body 25*b* is preferably from 0.4 to 0.8 mm, more preferably from 0.5 to 0.7 mm, and even more preferably from 0.55 to 0.65 mm. Similarly, the maximum displacement of the valve body 25*b* is preferably from 0.05 times to 0.1 times the diameter of the flow aperture 24*h*, more preferably from 0.06 times to 0.09 times, and even more preferably from 0.07 times to 0.08 times.

REFERENCE SIGNS LIST

1: Delaminatable Container, 2: Cap, 3: Container Body, 5: Valve Member, 7: Storage Portion, 9: Mouth, 15: Fresh Air Inlet, 21: Cap Body, 24: Main Cap Member, 24*h*: Flow Aperture, 24*i*: Inner Tube Section, 24*o*: Outer Tube Section, 24*r*: Annular Portion, 24*s*: Valve Seat, 25: Check Valve, 25*b*: Valve Body, 25*f*: Outer Frame, 25*p*: Elastic Piece, 26: Discharge Member, 26*d*: Disk Section, 26*g*: Tubular Guide Section, 26*m*: Outlet, 26*p*: Projection, 26*s*: Tubular Support Section, S: Intermediate Space.

The invention claimed is:

1. A cap comprising a cap body to be fitted to a mouth of a container, wherein the cap is configured to include: a valve seat having a flow aperture; a valve body to be separated from or seated on the valve seat so as to open and close the flow aperture; and a biasing member to bias the valve body in a seating direction, wherein the cap is configured to form a flow path through which contents flow immediately after the valve body starts to be displaced, and configured to expand the flow path proportionally as the displacement of the valve body increases, and the cap further includes a displacement restricting section to restrict the displacement of the valve body when discharging the contents, wherein the displacement restricting section restricts the displacement of the valve body to be 0.09 times or less a diameter of the flow aperture.

2. The cap of claim 1, wherein the displacement restricting section restricts the displacement of the valve body to 1.5 mm or less.

3. The cap of claim 1, wherein the displacement restricting section restricts the displacement of the valve body from 0.4 to 0.8 mm.

4. The cap of claim 1, wherein the biasing member is formed of a plurality of elastic pieces radially extending from an outer circumferential portion of the valve body.

5. The cap of claim 1, wherein the cap body includes: an inner tube section having the valve seat; and a discharge portion mounted to the inner tube section and having an outlet, the inner tube section and the discharge portion forming an intermediate space, and the cap is configured to displace the valve body in the intermediate space.

6. The cap of claim 5, wherein the displacement restricting section is formed of a plurality of projections formed on a surface on a side of the intermediate space of the discharge portion.

7. The cap of claim 5, wherein the displacement restricting section is formed of a spacer disposed between the discharge portion and the valve body.

8. A delaminatable container comprising a container body having an outer shell and an inner bag, the inner bag to be shrunk with a decrease in the contents, wherein a cap body to be fitted to a mouth of a container, wherein the cap is configured to include: a valve seat having a flow aperture; a valve body to be separated from or seated on the valve seat so as to open and close the flow aperture; and a biasing member to bias the valve body in a seating direction, wherein the cap is configured to form a flow path through which contents flow immediately after the valve body starts to be displaced, and configured to expand the flow path proportionally as the displacement of the valve body increases, and the cap further includes a displacement restricting section to restrict the displacement of the valve body when discharging the contents, wherein the displacement restricting section restricts the displacement of the valve body to be 0.09 times or less a diameter of the flow aperture.

9. The cap of claim 1, wherein the valve body is a member in a domical shape having an upwardly curved cross-sectional shape, and the displacement restricting section restricts the displacement of the valve body by abutting on the upper surface of the valve body.

10. The cap of claim 1, wherein the valve seat has an inner circumferential surface in a tapered shape, increasing in diameter in a direction of the flow path approaching a discharge member, wherein the valve body has an outer circumferential portion in a tapered shape, decreasing in diameter in a direction of the flow path approaching the discharge member, to be seated on the inner circumferential surface of the valve seat.

* * * * *